US008692469B2

(12) United States Patent
Shimizu et al.

(10) Patent No.: US 8,692,469 B2
(45) Date of Patent: Apr. 8, 2014

(54) LED DRIVE CIRCUIT AND LED ILLUMINATION APPARATUS USING THE SAME

(75) Inventors: Takayuki Shimizu, Osaka (JP); Atsushi Kanamori, Osaka (JP); Hirohisa Warita, Osaka (JP); Takeshi Murata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/618,534

(22) Filed: Sep. 14, 2012

(65) Prior Publication Data

US 2013/0076248 A1 Mar. 28, 2013

(30) Foreign Application Priority Data

Sep. 27, 2011 (JP) ..... 2011-210485

(51) Int. Cl.
*H05B 37/00* (2006.01)

(52) U.S. Cl.
USPC ..... 315/127; 315/119; 315/210; 315/308

(58) Field of Classification Search
USPC ..... 315/127, 119, 121, 122, 209 R, 210, 315/307–308, 291, 299–301
See application file for complete search history.

(56) References Cited

U.S. PATENT DOCUMENTS

| | | | | |
|---|---|---|---|---|
| 8,400,079 | B2 * | 3/2013 | Kanamori et al. | 315/307 |
| 8,421,371 | B2 * | 4/2013 | Shimizu et al. | 315/291 |
| 2008/0024074 | A1 * | 1/2008 | Mosebrook et al. | 315/291 |
| 2010/0295478 | A1 | 11/2010 | Wei et al. | |
| 2011/0140620 | A1 | 6/2011 | Lin et al. | |

FOREIGN PATENT DOCUMENTS

| | | | |
|---|---|---|---|
| EP | 2 257 124 | A1 | 12/2010 |
| JP | 2004-327152 | A | 11/2004 |
| JP | 2005-11739 | A | 1/2005 |
| JP | 2011-28954 | A | 2/2011 |

* cited by examiner

*Primary Examiner* — James H Cho
(74) *Attorney, Agent, or Firm* — Birch, Stewart, Kolasch & Birch, LLP

(57) ABSTRACT

An LED drive circuit connectable to a phase control type light adjuster includes a first reference voltage generation portion that generates a first reference voltage, a second reference voltage generation portion that generates a second reference voltage according to a phase angle of the light adjuster, an input voltage detection portion that detects a size relationship between an input voltage and a threshold value voltage, a current draw-out portion that draws out a current in accordance with the first reference voltage or the second reference voltage from an electricity supply line that supplies electricity to an LED drive portion, and a switch portion that in accordance with a detection result by the input voltage, detection portion, performs switching between an output from the first reference voltage generation portion to the current draw-out portion and an output from the second reference voltage generation portion to the current draw-out portion.

10 Claims, 13 Drawing Sheets

LED DRIVE CIRCUIT AND LED ILLUMINATION APPARATUS USING THE SAME

This application is based on Japanese Patent Application No. 2011-210485 filed on Sep. 27, 2011, the contents of which are hereby incorporated by reference.

BACKGROUND OF THE INVENTION

1. Field of the Invention

The present invention relates to an LED drive circuit and an LED illumination apparatus that uses the same.

2. Description of the Related Art

An LED (Light Emitting Diode) has features of low current consumption and long life and the like, and is finding its wide applications in not only a display apparatus but also an illumination apparatus and the like. Here, in an LED illumination apparatus, there are many cases where a plurality of LEDs are used to obtain a desired illuminance (e.g., see JP-A-2004-327152, JP-A-2005-11739, and JP-A-2011-28954).

A general illumination apparatus often uses a commercial a.c. power supply, and considering a case where an LED illumination apparatus is used instead of a general illumination apparatus such as an incandescent lamp and the like, it is desirable that like the general illumination apparatus, the LED illumination apparatus also is structured to use a commercial a.c. power supply.

Besides, in a case of performing light adjustment control of an incandescent lamp, a phase control type light adjuster (generally, called an incandescent lamp controller) is used, which is capable of easily performing light adjustment control of electricity supply to the incandescent lamp by means of a volume device only by turning on a switching device (generally, a thyristor and a TRIAC device) at a phase angle of an a.c. power supply voltage. However, in the case of performing light adjustment of an incandescent lamp by means of a phase control type light adjuster, it is known that when the light adjuster is connected to the incandescent lamp that has a small wattage, flickering and blinking occur and normal light adjustment is impossible.

In a case of performing light adjustment control of an LED illumination apparatus that uses an a.c. power supply, it is desirable that an existing phase control type light adjuster for an incandescent lamp is connectable as it is. By using an existing facility for light adjustment and an LED illumination apparatus as the illumination apparatus, it becomes possible to achieve dramatic power consumption reduction compared with the incandescent lamp. Besides, it is possible to secure compatibility without changing the facility for light adjustment to a facility dedicated to the LED illumination apparatus, which leads to reduction in facility cost.

Here, FIG. 12 shows a conventional example of an LED illumination system capable of performing light adjustment control of an LED illumination apparatus that uses an a.c. power supply. The LED illumination system shown in FIG. 12 includes: a phase control type light adjuster 200; an LED drive circuit 300 that has a diode bridge DB1 and a current limit portion IL; and an LED array 400 composed of LEDs that are connected in series with one another. The phase control type light adjuster 200 is connected in series between a commercial power supply 100 that is an a.c. power supply and the current limit portion IL. In the phase control type light adjuster 200, by varying a resistance value of a semi-fixed resistor Rvar, a TRIAC Tri is turned on at a power supply phase angle that depends on the resistance value. When a voltage across a capacitor Cc exceeds an on-voltage of a DIAC Di, a current flows to a gate of the TRIAC Tri, whereby the TRIAC Tri is turned on. By changing the resistance value of the semi-fixed resistor Rvar, it is possible to vary the phase angle at which the TRIAC Tri is turned on. Usually, the semi-fixed resistor Rvar is of rotation knob type or slide type, and by changing a rotation angle of the knob or changing a slide position, it is possible to perform light adjustment control of an illumination apparatus. Further, in the phase control type light adjuster 200, a noise alleviation circuit is composed of a capacitor Ca and an inductor L, and reduces noise that returns from the phase control type light adjuster 200 to an a.c. power supply line. FIG. 13 shows output waveforms from the light adjuster and output waveforms from the diode bridge DB1 that correspond respectively to phase angles 45°, 90°, and 135° of the phase control type light adjuster 200. As the phase angle becomes larger, an average voltage value of the output waveforms from the diode bridge becomes smaller. When the LED illumination apparatus is connected to the phase control type light adjuster 200, as the phase angle of the light adjuster becomes larger, the brightness becomes lower.

In the case where the LED array composed of the LEDs connected in series is connected to the phase control type light adjuster for an incandescent lamp; the phase angle of the phase control type light adjuster is made larger; and the brightness of the LEDs is made lower, when an output voltage from the diode bridge becomes smaller than a forward voltage at which the LED array begins to shine, the LEDs come not to shine and the current flowing to the light adjuster rapidly decreases. When the current flowing to the light adjuster rapidly decreases, the current flowing to the TRIAC in the light adjuster becomes lower than a hold current, accordingly, the TRIAC is turned off and output from the light adjuster stops and becomes unstable, whereby flickering occurs in the brightness of the LEDs. Besides, when the light adjuster output undergoes phase control and the TRIAC changes from an off-state to an on-state, the LEDs change from an off-state to an on-state, whereby impedance of the LEDs rapidly changes. According to this, there is a case where ringing occurs in an edge portion where an output voltage from the light adjuster rapidly changes; the TRIAC becomes unstable and is turned off; and flickering occurs in the brightness. A phenomenon occurs in which the timing the TRIAC is turned off deviates at every half period of the alternating current; and the TRIAC is unstable between turning-off and turning-on, whereby flickering occurs. Besides, there is also a case where the TRIAC, which is once turned off, is turned on after a time span; an oscillation phenomenon occurs in which the on/off repeats; and flickering occurs.

Besides, there are many cases where to achieve power factor improvement and EMI noise reduction, a filter circuit, which includes a resistor; an inductor; a diode; and a capacitor, is disposed between the diode bridge and the LED drive circuit. When the phase angle of the light adjuster becomes equal to or larger than 90°, the current flowing to the LED drive circuit decreases thanks to light adjustment operation of the LED drive circuit, and the output voltage from the light adjuster changes from increasing to decreasing, accordingly, the LED drive circuit operates thanks to electric charges accumulated in the capacitor in the filter circuit. According to this, there is a case where the current supplied from the light adjuster decreases rapidly; the current in the TRIAC in the light adjuster becomes lower than the hold current; the TRIAC is turned off and the light adjuster malfunctions; and flickering occurs.

Here, in the case of the conventional incandescent lamp load, the load is a filament formed of tungsten or the like, accordingly, at the time the TRIAC of the light adjuster is switched from the off-state to the on-state, the impedance change is less and the impedance keeps a low impedance state. Besides, there are not the diode bridge and the filter circuit, accordingly, the current flowing to the light adjuster does not change rapidly, and the stable light adjustment operation is possible until the a.c. power supply reaches near 0 V.

SUMMARY OF THE INVENTION

It is an object of the present invention to provide an LED drive circuit and an LED illumination apparatus that are capable of alleviating flickering of an LED and achieving efficiency improvement.

The present invention is an LED drive circuit which is connectable to a phase control type light adjuster and into which an input voltage based on an a.c. voltage that undergoes phase control performed by the phase control type light adjuster is input to drive an LED load, including:

an LED drive portion that drives the LED load;

a phase angle detection portion that detects a phase angle based on the input voltage;

a first reference voltage generation portion that generates a first reference voltage;

a second reference voltage generation portion that generates a second reference voltage in accordance with the phase angle detected by the phase angle detection portion;

an input voltage detection portion that detects a size relationship between the input voltage and a threshold value voltage;

a current draw-out portion that draws out a current in accordance with the first reference voltage or the second reference voltage from an electricity supply line that supplies electricity to the LED drive portion; and a switch portion that in accordance with a detection result by the input voltage detection portion, performs switching between an output from the first reference voltage generation portion to the current draw-out portion and an output from the second reference voltage generation portion to the current draw-out portion.

According to this structure, the current drawing-out based on the first reference voltage and the current drawing-out based on the second reference voltage are performed independent of each other and the current drawn out in accordance with the phase angle is varied, accordingly, it is possible to curb flickering of the LED by alleviating a current control means (e.g., a TRIAC and the like) in the phase control type light adjuster being turned off and to achieve efficiency improvement.

Besides, the first reference voltage generation portion may generate the first reference voltage in accordance with the phase angle detected by the phase angle detection portion.

Besides, in a case where the phase angle detected by the phase angle detection portion is near 0°, the first reference voltage generation portion may generate the first reference voltage at which the current draw-out portion does not draw out a current.

Besides, when the input voltage detection portion detects that the input voltage is equal to or smaller than the threshold value voltage, the LED drive portion may stop switching.

Besides, when the phase angle detected by the phase angle detection portion is in a range of 0° to 90°, the second reference voltage generation portion may generate the second reference voltage at which the current draw-out portion does not draw out a current, and may generate the second reference voltage at which as the phase angle detected by the phase angle detection portion becomes larger than 90°, the current drawn out by the current draw-out portion increases.

Besides, when the phase angle detected by the phase angle detection portion is equal to or larger than a predetermine phase angle that is larger than 90°, the second reference voltage generation portion may generate the second reference voltage at which the current drawn out by the current draw-out portion becomes constant.

Besides, when the phase angle detected by the phase angle detection portion becomes larger than a predetermined phase angle, the LED drive portion may turn off the LED load; and as the phase angle detected by the phase angle detection portion becomes larger than the predetermined phase angle, the second reference voltage generation portion may generate the second reference voltage at which the current drawn out by the current draw-out portion decreases to zero.

Besides, the second reference voltage generation portion may vary the second reference voltage that is generated during a half period of an a.c. period.

Besides, the phase angle detection portion may detect the phase angle at every half period of the a.c. period.

Besides, an LED illumination apparatus according to the present invention is structured to include the LED drive circuit having any one of the above structures and an LED load that is connected to an output side of the LED drive circuit.

DESCRIPTION OF THE PREFERRED EMBODIMENTS

Figure 1:
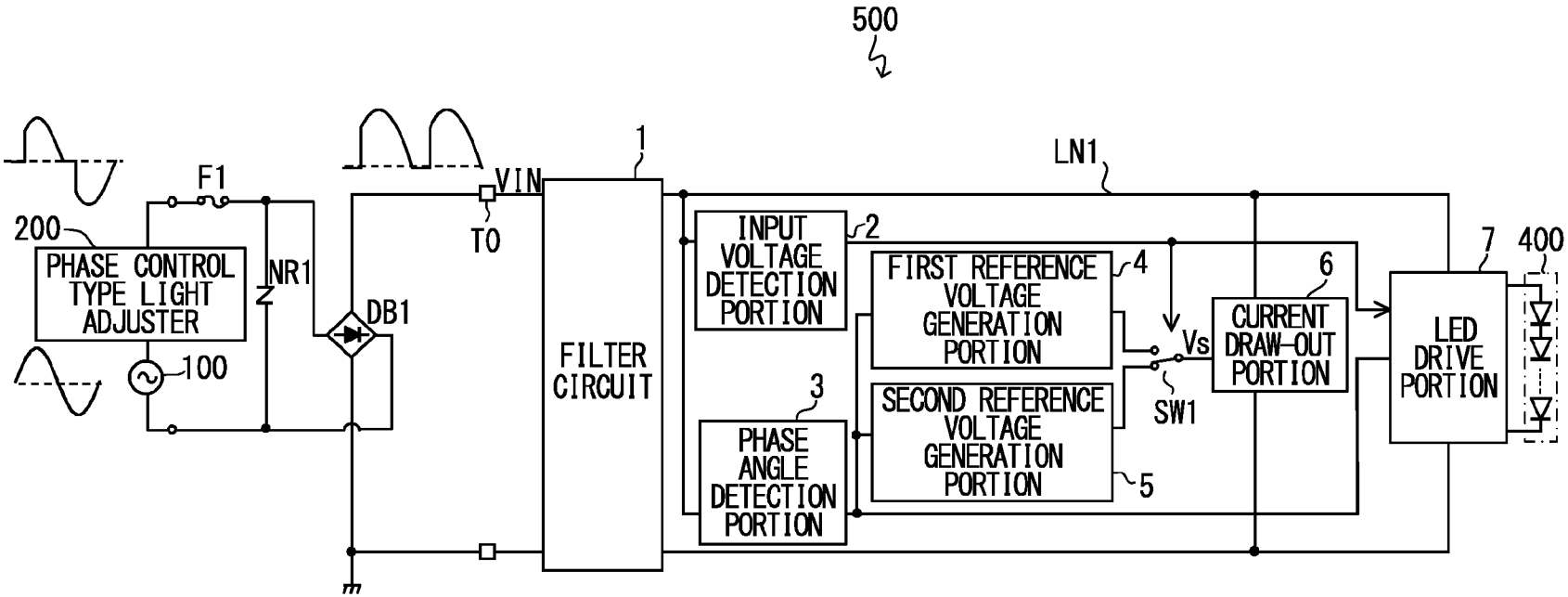
FIG. 1 is a view showing an entire structure of an LED illumination system according to an embodiment of the present invention.
Figure 2:
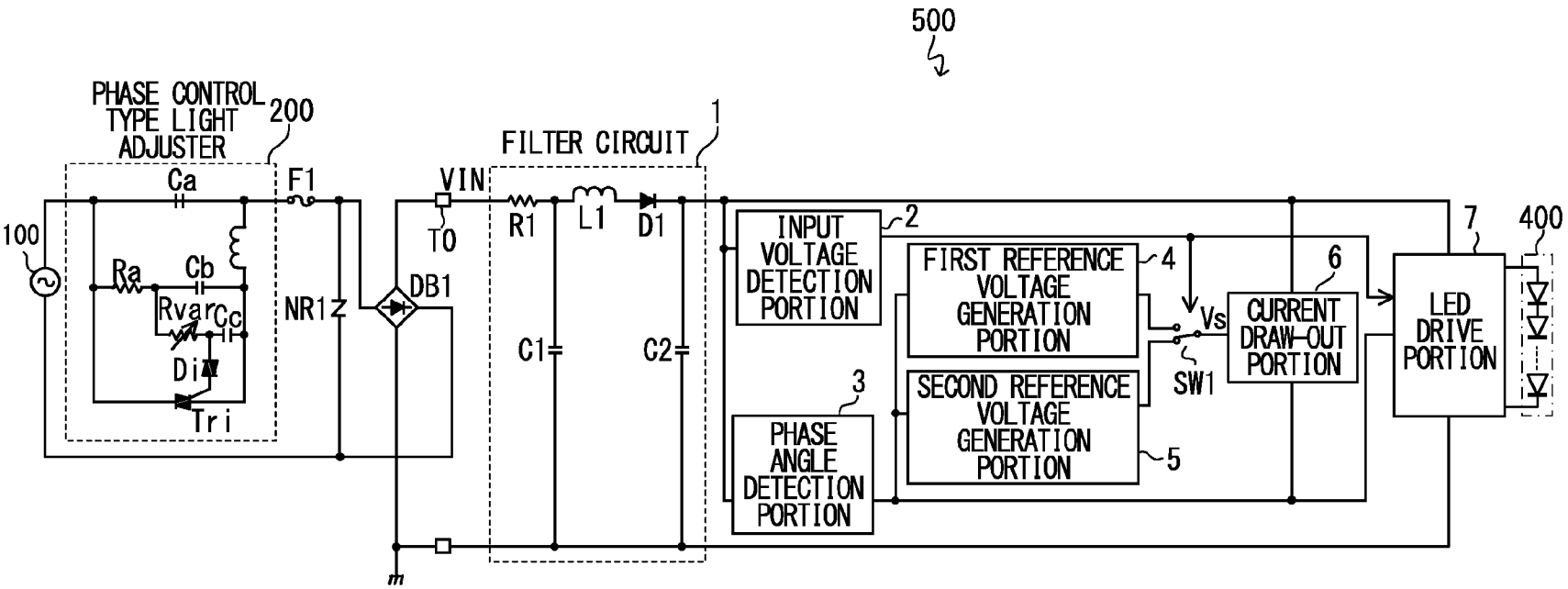
FIG. 2 is a view showing detailed structures of a phase control type light adjuster and a filter circuit of the LED illumination system shown in FIG. 1.

Hereinafter, an embodiment of the present invention is described with reference to drawings. FIG. 1 shows an entire structure of an LED illumination system according to the embodiment of the present invention. Besides, FIG. 2 shows an entire structure that illustrates detailed structures of a phase control type light adjuster and a filter circuit of the LED illumination system shown in FIG. 1.

The LED illumination system shown in FIG. 1 includes: a commercial power supply 100; a phase control type light adjuster (hereinafter, there is a case where it is simply described as a light adjuster) 200; a fuse F1; an anti-surge device NR1; a diode bridge DB1; an LED drive circuit 500; and an LED array 400. The commercial power supply 100 is connected to the diode bridge DB1 via the phase control type light adjuster 200 and the fuse F1, and the anti-surge device NR1 is connected between one end of the commercial power supply 100 and one end of the fuse F1. And, the LED drive circuit 500 is connected to an output side of the diode bridge DB1, and the LED array 400 is connected to an output side of the LED drive circuit 500. Here, the LED drive circuit 500 and the LED array 400 compose an LED illumination apparatus, and as examples of the LED illumination apparatus, there are an LED bulb and the like.

The commercial power supply 100 outputs a sine-wave a.c. voltage; the voltage differs depending on countries: there are voltages of 100 V to 250 V and frequencies of 50 Hz and 60 Hz. When the a.c. voltage is input into the phase control type light adjuster 200, in accordance with rotation or slide operation of a volume for performing light adjustment, a waveform cut out at a phase point of the a.c. waveform is generated. The output waveform from the phase control type light adjuster 200 undergoes full-wave rectification performed by the diode bridge DB1, and a pulsation waveform, which has a frequency two times (100 Hz in a case of 50 Hz, 120 Hz in a case of 60 Hz) as high as the input frequency, is input to an input terminal T0 of the LED drive circuit 500.

The LED drive circuit 500 has: a filter circuit 1; an input voltage detection portion 2; a phase angle detection portion 3; a first reference voltage generation portion 4; a second reference voltage generation portion 5; a current draw-out portion 6; and an LED drive portion 7.

The filter circuit 1, which aims to achieve power factor improvement and reduce EMI noise radiated to outside by attenuating switching noise of the LED drive portion 7, is, as shown in FIG. 2, composed of a resistor R1, an inductor L1, a diode D1, capacitors C1 and C2.

Based on an input voltage VIN that is input from the diode bridge DB1 to the input terminal T0, the phase angle detection portion 3 detects a phase angle of the phase control type light adjuster 200. The LED drive portion 7 varies a current to be flown to the LED array 400 in accordance with the phase angle detected by the phase angle detection portion 3, thereby performing the light adjustment.

Figure 11:
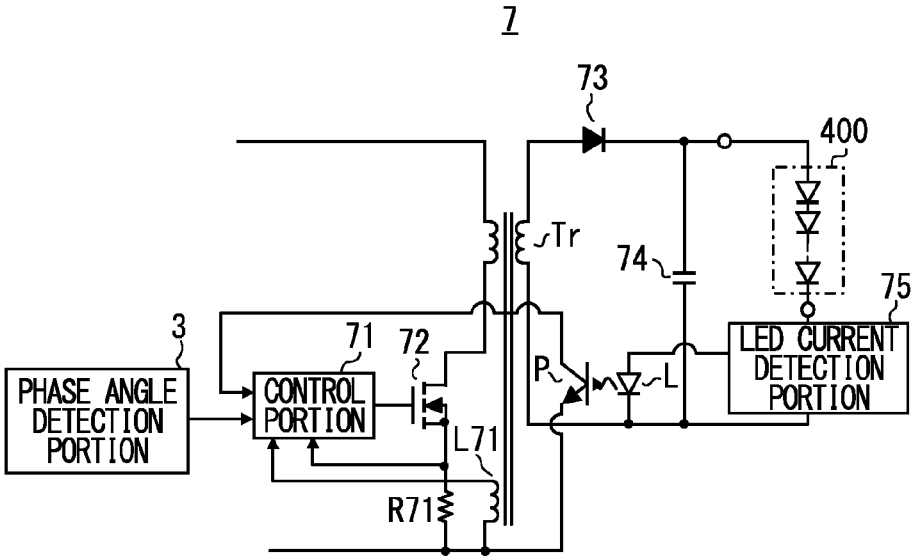
FIG. 11 is a view showing a structure of an LED drive portion according to an embodiment of the present invention.
Figure 12:
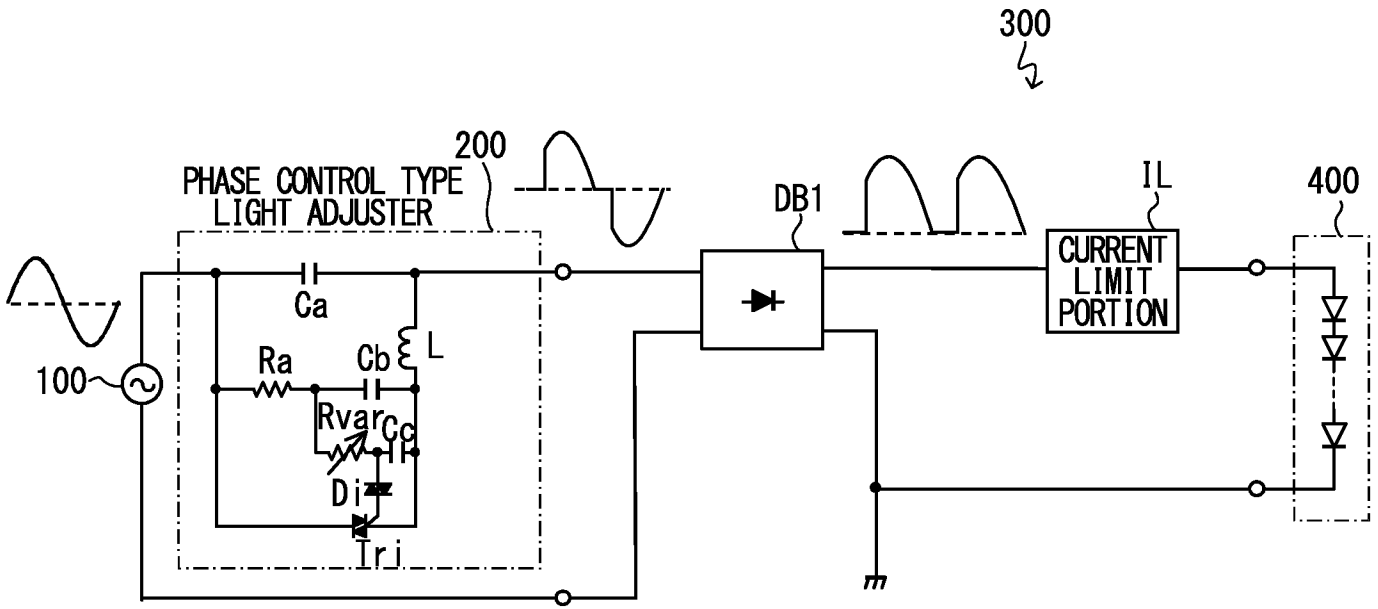
FIG.12 RELATED ART
FIG. 12 is a view showing a conventional example of an LED illumination system.
Figure 13:
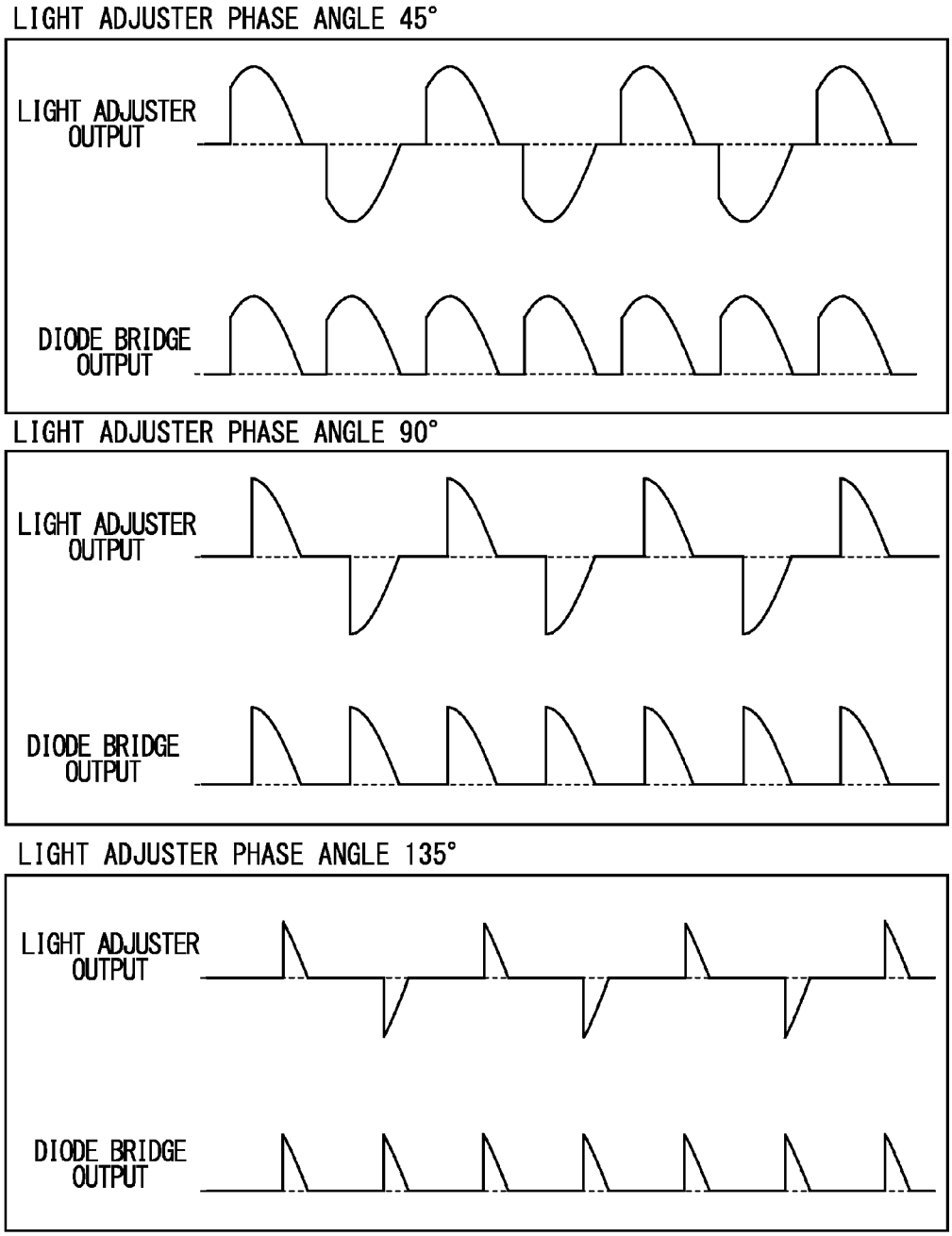
FIG.13 RELATED ART
FIG. 13 is a view showing waveforms of a light adjuster output and a diode bridge output at every light adjuster phase angle.

FIG. 11 shows a structural example in a case where the LED drive portion 7 is composed as a pseudo-resonance flyback converter. The LED drive portion 7 shown in FIG. 11 has: a control portion 71; a switching device 72; a diode 73; a capacitor 74; an LED current detection portion 75; a transformer Tr; a light emitting diode L; a photo transistor P; a resistor R71; and an auxiliary winding L71. An LED current detection signal is input from the LED current detection portion 75 into the control portion 71 via the light emitting diode L and the photo transistor P. Based on the LED current detection signal and a phase angle detection signal that is input from the phase angle detection portion 3, the control portion 71 applies switching control to the switching device 72, thereby controlling the LED current to be constant.

The first reference voltage generation portion 4 and the second reference voltage generation portion 5 generate a reference voltage that corresponds to the phase angle detected by the phase angle detection portion 3. The input voltage detection portion 2 detects whether the input voltage VIN is equal to or smaller than a predetermined threshold value voltage, and switches a switch SW1 in accordance with the detection result.

Upon detecting that the input voltage VIN is equal to or smaller than the threshold value voltage, the input voltage detection portion 2 switches the switch SW1 such that the first reference voltage output from the first reference voltage generation portion 4 is input into the current draw-out portion 6. On the other hand, upon detecting that the input voltage VIN exceeds the threshold value voltage, the input voltage detection portion 2 switches the switch SW1 such that the second reference voltage output from the second reference voltage generation portion 5 is input into the current draw-out portion 6. The current draw-out portion 6 draws out a current, which is proportional to the first reference voltage or the second reference voltage, from a electricity supply line LN1 that supplies electricity to the LED drive portion 7.

Figure 3:
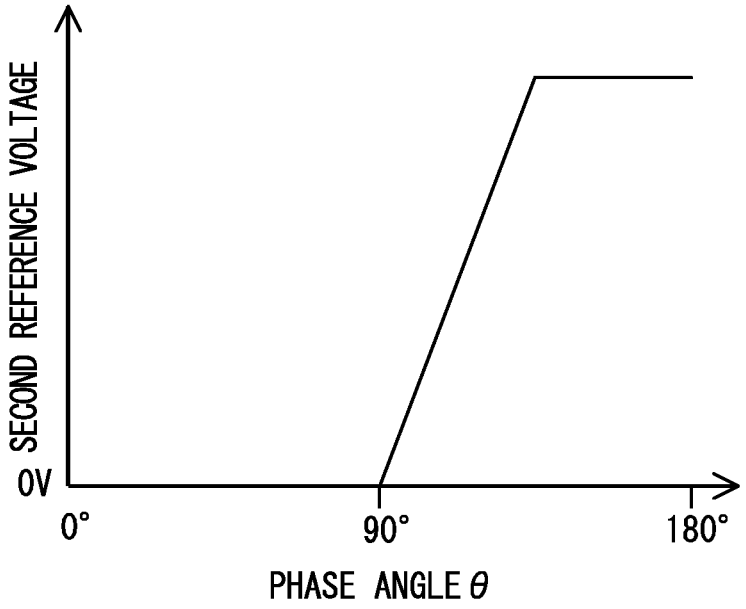
FIG. 3 is a graph showing a relationship between a phase angle and a second reference voltage according to an embodiment of the present invention.

FIG. 3 illustrates an example of a graph that shows a relationship between the second reference voltage generated by the second reference voltage generation portion 5 and the phase angle of the light adjuster 200. When the phase angle of the light adjuster 200 is in a range of 0° to 90°, the brightness of the LED array 400 is high thanks to light adjustment operation of the LED drive portion 7, and the current flowing to the LED drive portion 7 is large. Further, the input voltage VIN rises monotonously, whereby the capacitor 2 is charged via the diode D1 in the filter circuit 1. Accordingly, the current drawn out from the light adjuster 200 becomes large, and the TRIAC Tri is unlikely to be turned off. However, when the phase angle of the light adjuster 200 becomes larger than 90°, the brightness of the LED array 400 becomes lower rapidly as the phase angle of the light adjuster 200 becomes larger, whereby the current flowing to the LED drive portion 7 decreases. Further, the input voltage VIN decreases monotonously, accordingly, part of the current consumed by the LED drive portion 7 is supplied from the capacitor C5. Accordingly, the current drawn out from the light adjuster 200 becomes small, whereby the TRIAC Tri goes into a state to be easily turned off.

Because of this reason, as shown in FIG. 3, when the phase angle of the light adjuster 200 is in the range of 0° to 90°, the second reference voltage is kept at 0 V; as the phase angle becomes larger than 90°, the second reference voltage is increased; and when the phase angle is equal to or larger than a value, the second reference voltage is kept constant.

Figure 4:
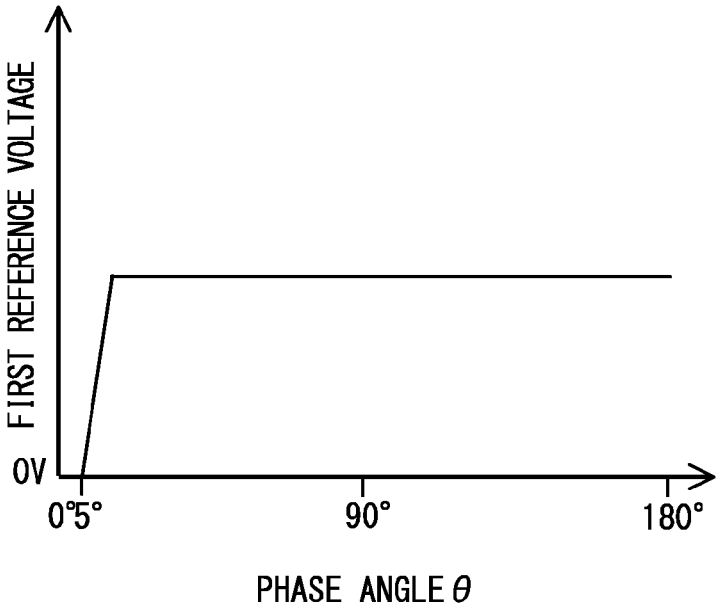
FIG. 4 is a graph showing a relationship between a phase angle and a first reference voltage according to an embodiment of the present invention.

Besides, FIG. 4 illustrates an example of a graph that shows a relationship between the first reference voltage generated by the first reference voltage generation portion 4 and the phase angle of the light adjuster 200. The phase angle of a general light adjuster ranges from 30° to 160°, accordingly, in a case where the phase angle is equal to or smaller than 5°, it is possible to determine that the light adjuster is not connected. When the light adjuster is not connected, it is not necessary to draw out a current that prevents the TRIAC in the light adjuster from being turned off. Because of this, as shown in FIG. 4, when the phase angle of the light adjuster 200 is in a range of 0° to 5°, the first reference voltage is kept at 0 V. And, as the phase angle becomes larger than 5°, the first reference voltage is increased; and when the phase angle is equal to or larger than a value, the first reference voltage is kept constant. According to this, in the case where the light adjuster is not connected, the current is not drawn out, accordingly, it is possible to reduce the power consumption.

Figure 5:
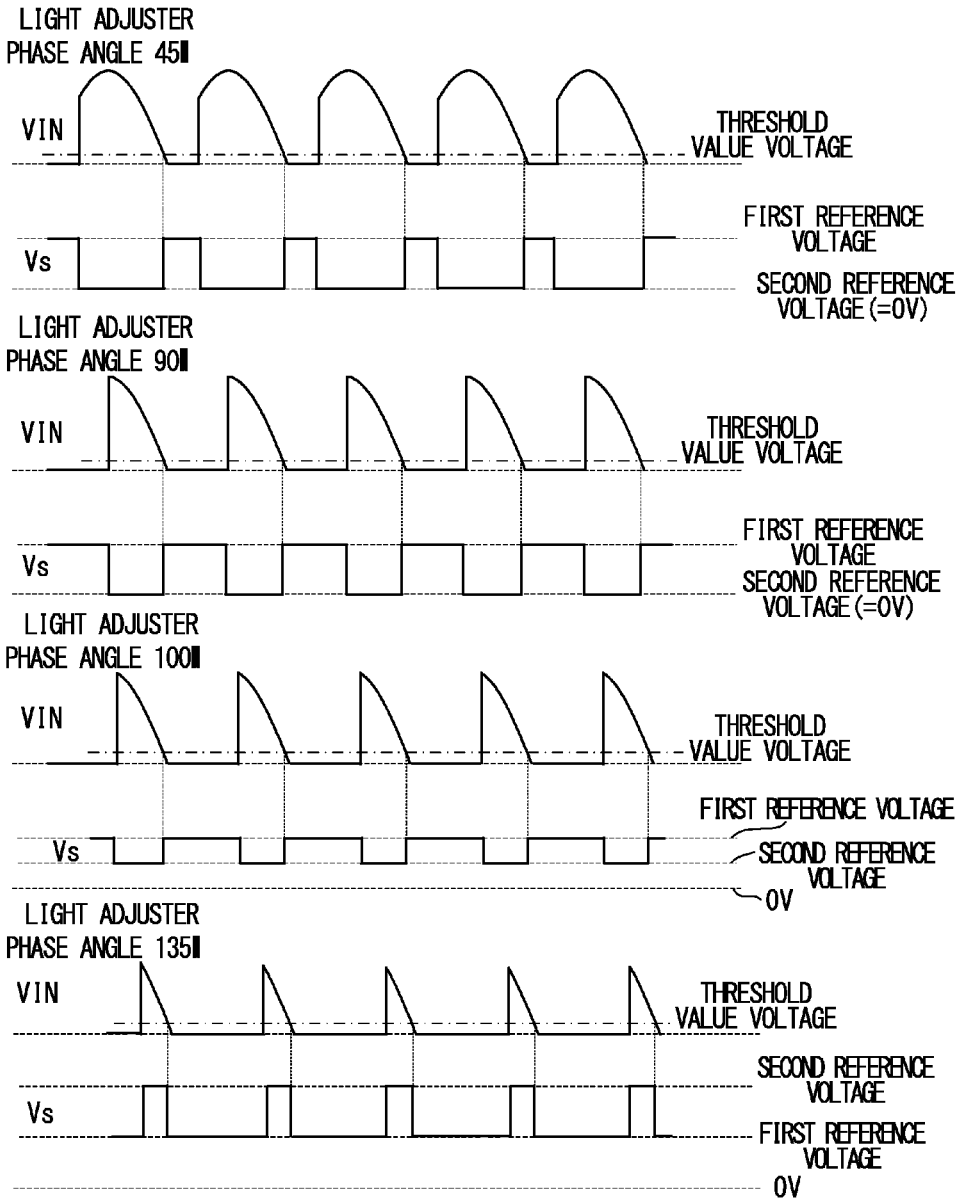
FIG. 5 is a view showing waveform examples of an input voltage and a reference voltage at every light adjustment phase angle according to an embodiment of the present invention.

In a case where FIG. 3 and FIG. 4 are used as characteristics of the reference voltage, FIG. 5 shows waveforms of the input voltage VIN and a reference voltage Vs input into the current draw-out portion 6 at the time the phase angle of the light adjuster 200 is 45°, 90°, 100°, and 135°. When the input voltage VIN is equal to or smaller than the threshold value voltage, the first reference voltage is selected as the reference voltage Vs, while when the input voltage VIN exceeds the threshold value voltage, the second reference voltage is selected as the reference voltage Vs.

When the input voltage VIN exceeds the threshold value voltage, the second reference voltage in accordance with the detected phase angle is input into the current draw-out portion 6, and a current proportional to the second reference voltage is drawn out by the current draw-out portion 6, accordingly, it is possible to prevent the TRIAC Tri in the light adjuster 200 from being turned off and to improve the efficiency by drawing out a suitable amount of current. Besides, when the input voltage VIN is equal to or smaller than the threshold value voltage, the first reference voltage is input into the current draw-out portion 6, and a current proportional to the first reference voltage is drawn out by the current draw-out portion 6, accordingly, it is possible to prevent the TRIAC Tri from being turned off when the LED array 400 is turned off. Besides, the reference voltage is switched for an on-time span and an off-time span of the input voltage VIN to vary the drawn-out current, accordingly, it is possible to improve the efficiency. As described above, by preventing the TRIAC from being turned off, it is possible to achieve the light adjustment that alleviates flickering and hysteresis of the brightness (conventionally, when the phase angle of the light adjuster is changed from small→large and large→small, hysteresis occurs in the brightness of the LED).

Here, the first reference voltage may be set at a constant value irrespective of the phase angle of the light adjuster 200. In other words, the first reference voltage may not be invariably generated in accordance with the detected phase angle.

Figure 6:
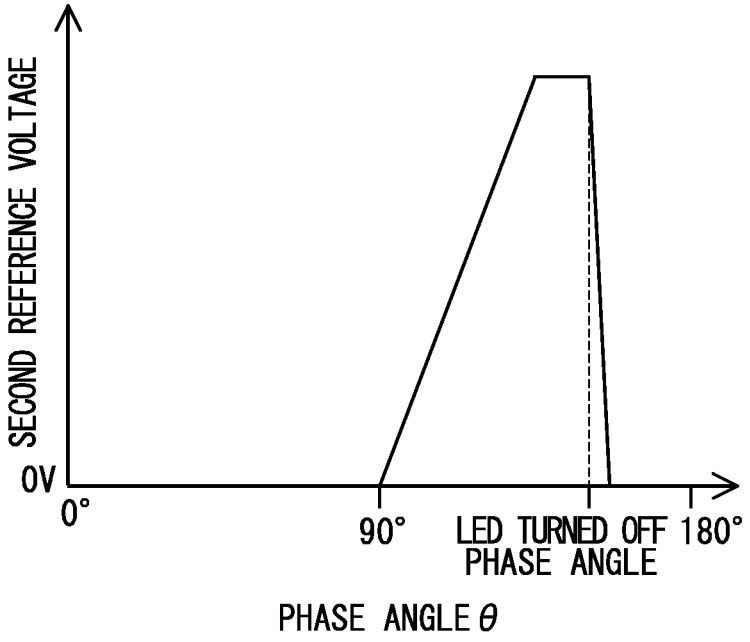
FIG. 6 is a graph showing a relationship between a phase angle and a second reference voltage according to an embodiment of the present invention.

FIG. 6 illustrates another example of a graph that shows a relationship between the second reference voltage generated by the second reference voltage generation portion 5 and the phase angle of the light adjuster 200. In the present embodiment, when the phase angle detected by the phase angle detection portion 3 becomes larger than a predetermined phase angle (LED turning-off phase angle), the LED drive portion 7 turns off the LED array 400. According to the characteristic shown in FIG. 6, as the phase angle of the light adjuster 200 becomes larger than 90°, the second reference voltage is increased; when the phase angle is equal to or larger than a value, the second reference voltage is kept constant; and as the phase angle becomes larger than the LED turning-off phase angle, the second reference voltage is decreased to 0 V. In a case where the LED is turned off, even if the TRIAC Tri in the light adjuster 200 is turned off, flickering does not occur, accordingly, the drawn-out current may be made small. According to this, it is possible to reduce the power consumption at the time of turning off the LED.

Besides, during a low voltage time span when the first reference voltage is selected (in other words, when the input voltage detection portion 2 detects that the input voltage VIN is equal to or smaller than the threshold value voltage), the switching of the LED drive portion 7 may be stopped. In the case where the LED drive portion 7 is composed of a flyback converter (e.g., FIG. 11), during the time the input is a low voltage, it is possible to prevent a switching frequency from becoming low and going into an audible band to cause a sound to occur. Describing specifically a cause that the switching frequency becomes low during the time the input is a low voltage, for example, in the case of the pseudo-resonance flyback converter shown in FIG. 11, when the control portion 71 detects by means of the resistor R71 that a current flowing to a primary coil of the transformer Tr reaches a threshold value Ion, the control portion 71 turns off the switching device 72. When the switching device 72 is turned off, a current flows in a forward direction in the diode 73 on a secondary side. And, when the control portion 71 detects by means of the auxiliary winding L71 that the current in the diode 73 on the secondary side becomes zero, the control portion 71 turns on the switching device 72. Here, the threshold value Ion is set in accordance with the phase angle detected by the phase angle detection portion 3; and the larger the phase angle is, the smaller the threshold value Ion is set. Besides, the threshold value Ion is adjusted based on a relationship between the LED current detected by the LED current detection portion 75 and a target current value in accordance with the phase angle detected by the phase angle detection portion 3. Here, when the input voltage is Vin, a time span Ton during which the current flowing to the primary coil of the transformer Tr reaches the threshold value Ion is expressed by the following formula:

$$Ton = L1 \times Ion / Vin$$

L1: the inductance of the primary coil of the transformer Tr
Ion: the threshold value current
Vin: the input voltage According to the above formula, Ton is in inverse proportion to the input voltage Vin, accordingly, during the time the input is a low voltage, Ton becomes large and the switching frequency becomes low.

Figure 7:
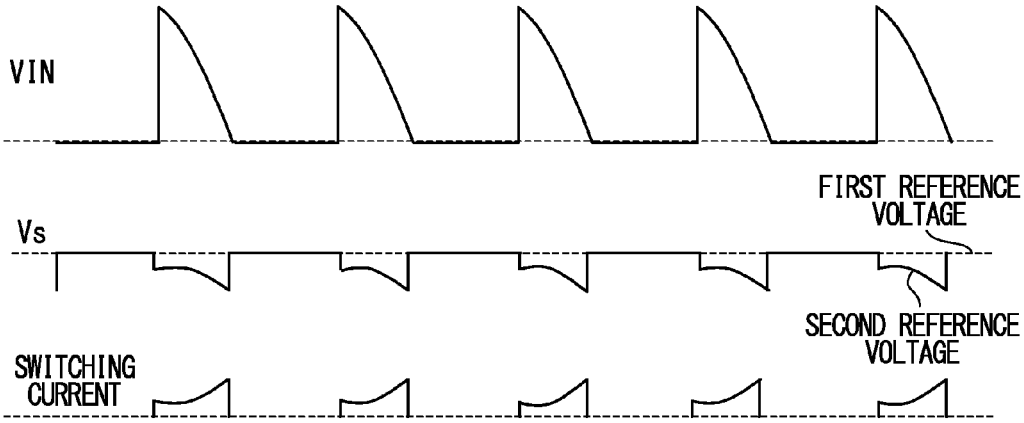
FIG. 7 is a view showing waveform examples of an input voltage, a reference voltage, and a switching current according to an embodiment of the present invention.

Besides, FIG. 7 shows the respective waveforms of the input voltage VIN, the reference voltage Vs input into the current draw-out portion 6, and the switching current (average value) in the LED drive portion 7 according to another embodiment of the present invention. In the embodiment in FIG. 5 described above, the second reference voltage is kept constant during the half period of the a.c. period; however, in FIG. 7, the second reference voltage is made variable during the half period of the a.c. period. More specifically, when the switching current is small, the second reference voltage is made large to increase the drawn-out current, while when the switching current is large, the second reference voltage is made small to decrease the drawn-out current, and control is performed such that the sum of the switching current and the drawn-out current becomes a constant value. Here, the second reference voltage at the time point the input voltage VIN rises to exceed the threshold value voltage may be set at a value in accordance with the phase angle. Thanks to the variable control of the drawn-out current, it is possible to improve the efficiency.

Figure 8:
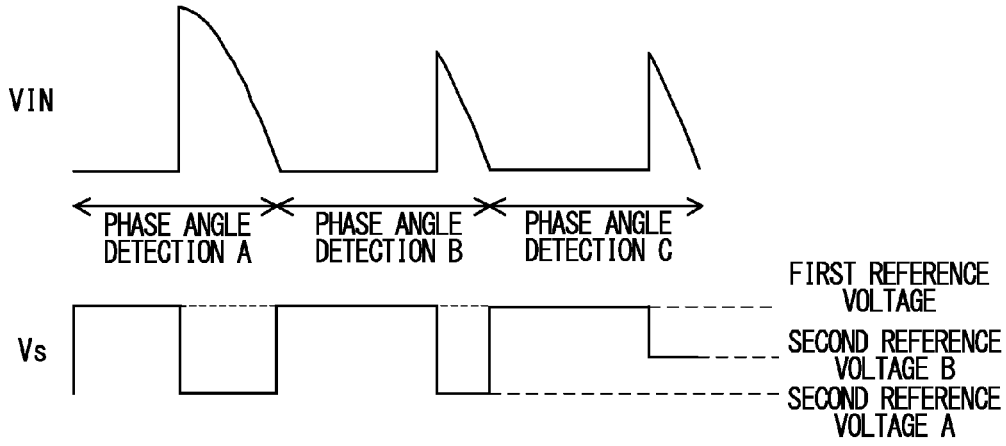
FIG. 8 is a view showing waveform examples of an input voltage and a reference voltage according to an embodiment of the present invention.
Figure 9:
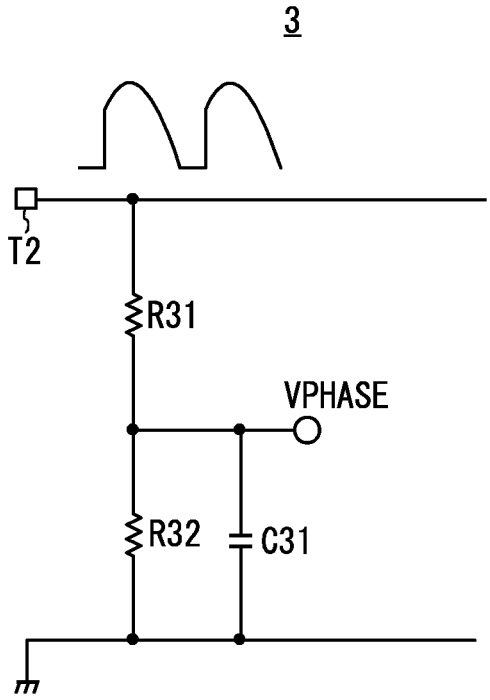
FIG. 9 is a view showing a structure of a phase angle detection portion according to an embodiment of the present invention.

Besides, FIG. 8 shows the respective waveforms of the input voltage VIN and the reference voltage Vs input into the current draw-out portion 6 according to still another embodiment of the present invention. For example, as shown in FIG. 9, in a case where the phase angle detection portion 3 is composed as a low pass filter that includes resistors R31, R32 and a capacitor C31, the phase angle detection portion 3 smooths the voltage waveform input from an input terminal T2, and outputs the detected phase angle as a voltage VPHASE. In other words, when the phase angle is small, the voltage VPHASE becomes high; when the phase angle is large, the voltage VPHASE becomes low. However, in a case where the phase angle rapidly changes when a knob of the light adjuster 200 is rotated fast, thanks to a characteristic of the low pass filter, a delay occurs in the change of the voltage VPHASE. Hence, there is a case where even if the second reference voltage is changed in accordance with the voltage VPHASE, it is impossible to generate the suitable second reference voltage and to perform the suitable current drawing-out, whereby there is a case where the TRIAC Tri in the light adjuster 200 is turned off.

Because of this, in the present embodiment, as shown in FIG. 8, the phase angle of the light adjuster 200 is detected during the half period of the a.c. period, and the second reference voltage in accordance with the detected phase angle is set during the next half period. According to this, even in the case where the phase angle of the light adjuster 200 rapidly changes, it is possible to alleviate the delay in tracking the drawn-out current as small as possible, and it is possible to prevent the TRIAC Tri from being turned off.

Figure 10:
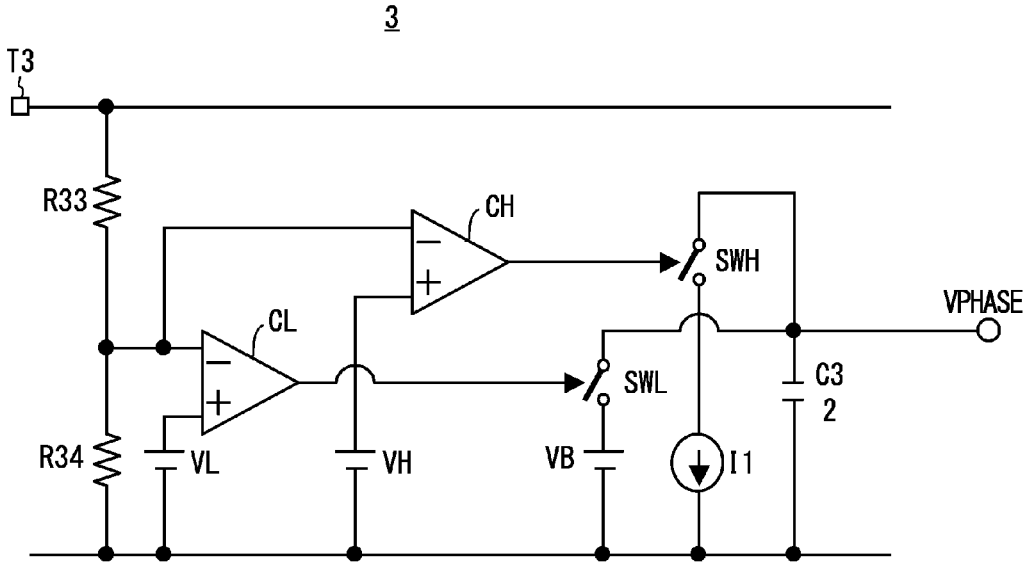
FIG. 10 is a view showing a structure of a phase angle detection portion according to an embodiment of the present invention.

FIG. 10 shows a structural example of the phase angle detection portion 3 according to the present embodiment. The phase angle detection portion 3 has: an input terminal T3; resistors R33 and R34; comparators CL, CH: switches SWL, SWH: a constant current source I1; and a capacitor C32. The resistor R33 and the resistor R34 are connected in series with each other between an input voltage line and a reference voltage line. A divided voltage by the resistors R33, R34 is input to an inverting terminal of the comparator CL, and a reference voltage VL is input to a non-inverting terminal of the comparator CL. An output from the comparator CL drives the switch SWL. Besides, the divided voltage by the resistors R33, R34 is input to an inverting terminal of the comparator CH, and a reference voltage VH (>VL) is input to a non-inverting terminal of the comparator CH. An output from the comparator CH drives the switch SWH. Besides, to one end of the capacitor C32, a reference voltage VB is applied via the switch SWL, the constant current source I1 is connected via the switch SWH, and the voltage VPHASE is output from the one end.

In the above structure, when the divided voltage by the resistors R33, R34 is equal to or smaller than the reference voltage VL, the input voltage input from the input terminal T3 is regarded as 0 V, the switches SWL, SWH are turned on, the voltage VPHASE becomes the reference voltage VB, and the capacitor C32 is charged. And, when the divided voltage by the resistors R33, R34 exceeds the reference voltage VL but is equal to or smaller than the reference voltage VH, it is deemed that the input voltage does not rise yet, the switch SWL is turned off and the switch SWH is in an on-state, accordingly, the capacitor C32 is discharged by the constant current source I1. And, when the divided voltage by the resistors R33, R34 exceeds the reference voltage VH, it is deemed that the input voltage rises, the switches SWL, SWH are turned off, and the discharge of the capacitor C32 is stopped. According to this operation, it is possible to generate the voltage VPHASE in accordance with a time span during which the input voltage rises from 0 V, that is, the phase angle.

Hereinbefore, the embodiments of the present invention are described; however, the embodiments are variously modifiable within the scope of the spirit of the present invention.

What is claimed is:

1. An LED drive circuit which is connectable to a phase control type light adjuster and into which an input voltage based on an a.c. voltage that undergoes phase control performed by the phase control type light adjuster is input to drive an LED load, comprising:

an LED drive portion that drives the LED load;

a phase angle detection portion that detects a phase angle based on the input voltage;

a first reference voltage generation portion that generates a first reference voltage;

a second reference voltage generation portion that generates a second reference voltage in accordance with the phase angle detected by the phase angle detection portion;

an input voltage detection portion that detects a size relationship between the input voltage and a threshold value voltage;

a current draw-out portion that draws out a current in accordance with the first reference voltage or the second reference voltage from an electricity supply line that supplies electricity to the LED drive portion; and a switch portion that in accordance with a detection result by the input voltage detection portion, performs switching between an output from the first reference voltage generation portion to the current draw-out portion and an output from the second reference voltage generation portion to the current draw-out portion.

2. The LED drive circuit according to claim 1, wherein the first reference voltage generation portion generates the first reference voltage in accordance with the phase angle detected by the phase angle detection portion.

3. The LED drive circuit according to claim 2, wherein in a case where the phase angle detected by the phase angle detection portion is near 0°, the first reference voltage generation portion generates the first reference voltage at which the current draw-out portion does not draw out a current.

4. The LED drive circuit according to claim 1, wherein when the input voltage detection portion detects that the input voltage is equal to or smaller than the threshold value voltage, the LED drive portion stops switching.

5. The LED drive circuit according to claim 1, wherein when the phase angle detected by the phase angle detection portion is in a range of 0° to 90°, the second reference voltage generation portion generates the second reference voltage at which the current draw-out portion does not draw out a current, and generates the second reference voltage at which as the phase angle detected by the phase angle detection portion becomes larger than 90°, the current drawn out by the current draw-out portion increases.

6. The LED drive circuit according to claim 5, wherein when the phase angle detected by the phase angle detection portion is equal to or larger than a predetermine phase angle that is larger than 90°, the second reference voltage generation portion generates the second reference voltage at which the current drawn out by the current draw-out portion becomes constant.

7. The LED drive circuit according to claim 1, wherein when the phase angle detected by the phase angle detection portion becomes larger than a predetermined phase angle, the LED drive portion turns off the LED load; and as the phase angle detected by the phase angle detection portion becomes larger than the predetermined phase angle, the second reference voltage generation portion generates the second reference voltage at which the current drawn out by the current draw-out portion decreases to zero.

8. The LED drive circuit according to claim 1, wherein the second reference voltage generation portion varies the second reference voltage that is generated during a half period of an a.c. period.

9. The LED drive circuit according to claim 1, wherein the phase angle detection portion detects the phase angle at every half period of an a.c. period.

10. An LED illumination apparatus comprising:

an LED drive circuit which is connectable to a phase control type light adjuster and into which an input voltage based on an a.c. voltage that undergoes phase control performed by the phase control type light adjuster is input to drive an LED load, including:

an LED drive portion that drives the LED load, a phase angle detection portion that detects a phase angle based on the input voltage, a first reference voltage generation portion that generates a first reference voltage, a second reference voltage generation portion that generates a second reference voltage in accordance with the phase angle detected by the phase angle detection portion, an input voltage detection portion that detects a size relationship between the input voltage and a threshold value voltage, a current draw-out portion that draws out a current in accordance with the first reference voltage or the second reference voltage from an electricity supply line that supplies electricity to the LED drive portion, and a switch portion that in accordance with a detection result by the input voltage detection portion, performs switching between an output from the first reference voltage generation portion to the current draw-out portion and an output from the second reference voltage generation portion to the current draw-out portion; and an LED load that is connected to an output side of the LED drive circuit.

* * * * *